US005288257A

United States Patent [19]

Zacherl

[11] Patent Number: 5,288,257

[45] Date of Patent: Feb. 22, 1994

[54] TOY FIGURE DOOR STOP HAVING DOOR ADHERING/SUCTION CUPS

[76] Inventor: Debra A. Zacherl, Rd. #2, Box 189A, Oil City, Pa. 16301

[21] Appl. No.: 14,742

[22] Filed: Feb. 8, 1993

[51] Int. Cl.[5] ..... A63H 3/00; A63H 3/46

[52] U.S. Cl. ..... 446/72; 446/177; 446/313; 446/370; 292/DIG. 19

[58] Field of Search ..... 446/72, 92, 177, 313, 446/369, 370, 371, 373, 375, 376, 390, 901; 292/DIG. 7, DIG. 19, 339; 16/374, 375

[56] References Cited

U.S. PATENT DOCUMENTS

| | | | |
|---|---|---|---|
| 1,710,989 | 4/1929 | Kelly | 446/117 |
| 2,219,130 | 10/1940 | Herrmann | 446/117 |
| 2,407,367 | 9/1946 | Geller | 446/376 |
| 3,699,715 | 10/1972 | Lewis et al. | 446/376 |
| 3,840,974 | 10/1974 | Georgen et al. | 446/371 X |
| 4,152,865 | 5/1979 | Ikeda | 446/72 |
| 4,233,775 | 11/1980 | Nenfeld | 446/370 |
| 4,235,041 | 11/1980 | Sweel | 446/177 |
| 5,078,640 | 1/1992 | Berman | 446/72 |

FOREIGN PATENT DOCUMENTS

| | | | |
|---|---|---|---|
| 139412 | 11/1950 | Australia | 446/375 |
| 523823 | 4/1956 | Canada | 446/177 |
| 2224949 | 5/1990 | United Kingdom | 446/369 |

*Primary Examiner*—David N. Muir
*Attorney, Agent, or Firm*—Leon Gilden

[57] ABSTRACT

An elongate flexible body, having a central body rod, is arranged with the body having forward and rear pairs of appendages directed from the body, with each of the appendages including an appendage rod, and each appendage rod free distal end mounts a pivot shaft through a polymeric bushing, with each pivot shaft mounting a suction cup member thereto, wherein forward and rear pairs of suction cup members of facing relationship are arranged for securement to opposed sides of a door member to prevent inadvertent closing of the door.

3 Claims, 4 Drawing Sheets

TOY FIGURE DOOR STOP HAVING DOOR ADHERING/SUCTION CUPS

BACKGROUND OF THE INVENTION

1. Field of the Invention

The field of invention relates to door stop structure, and more particularly pertains to a new and improved toy door stop wherein the same is arranged for the ease of mounting relative to a door member.

2. Description of the Prior Art

Door stops of various types have been utilized in the prior art and exemplified by the U.S. Pat. Nos. 5,044,681; 5,010,622; 4,657,293; and 4,998,941.

The instant invention attempts to overcome deficiencies of the prior art by directing the use to a door stop enhancing use by children and the like for entertainment and amusement of such children during use and in this respect, the present invention substantially fulfills this need.

SUMMARY OF THE INVENTION

In view of the foregoing disadvantages inherent in the known types of door stop apparatus now present in the prior art, the present invention provides a top door stop wherein a flexible body having a spine member of malleable rod construction includes suction cups for mounting the door stop structure to opposed sides of an associated door. As such, the general purpose of the present invention, which will be described subsequently in greater detail, is to provide a new and improved toy door stop which has all the advantages of the prior art door stop structure and none of the disadvantages.

To attain this, the present invention provides an elongate flexible body, having a central body rod, is arranged with the body having forward and rear pairs of appendages directed from the body, with each of the appendages including an appendage rod, and each appendage rod free distal end mounts a pivot shaft through a polymeric bushing, with each pivot shaft mounting a suction cup member thereto, wherein forward and rear pairs of suction cup members of facing relationship are arranged for securement to opposed sides of a door member to prevent inadvertent closing of the door.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy door stop which has all the advantages of the prior art door stop apparatus and none of the disadvantages.

It is another object of the present invention to provide a new and improved toy door stop which may be easily and efficiently manufactured and marketed.

It is a further object of the present invention to provide a new and improved toy door stop which is of a durable and reliable construction.

An even further object of the present invention is to provide a new and improved toy door stop which is susceptible of a low cost of manufacture with regard to both materials and labor, and which accordingly is then susceptible of low prices of sale to the consuming public, thereby making such toy door stops economically available to the buying public.

Still yet another object of the present invention is to provide a new and improved toy door stop which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
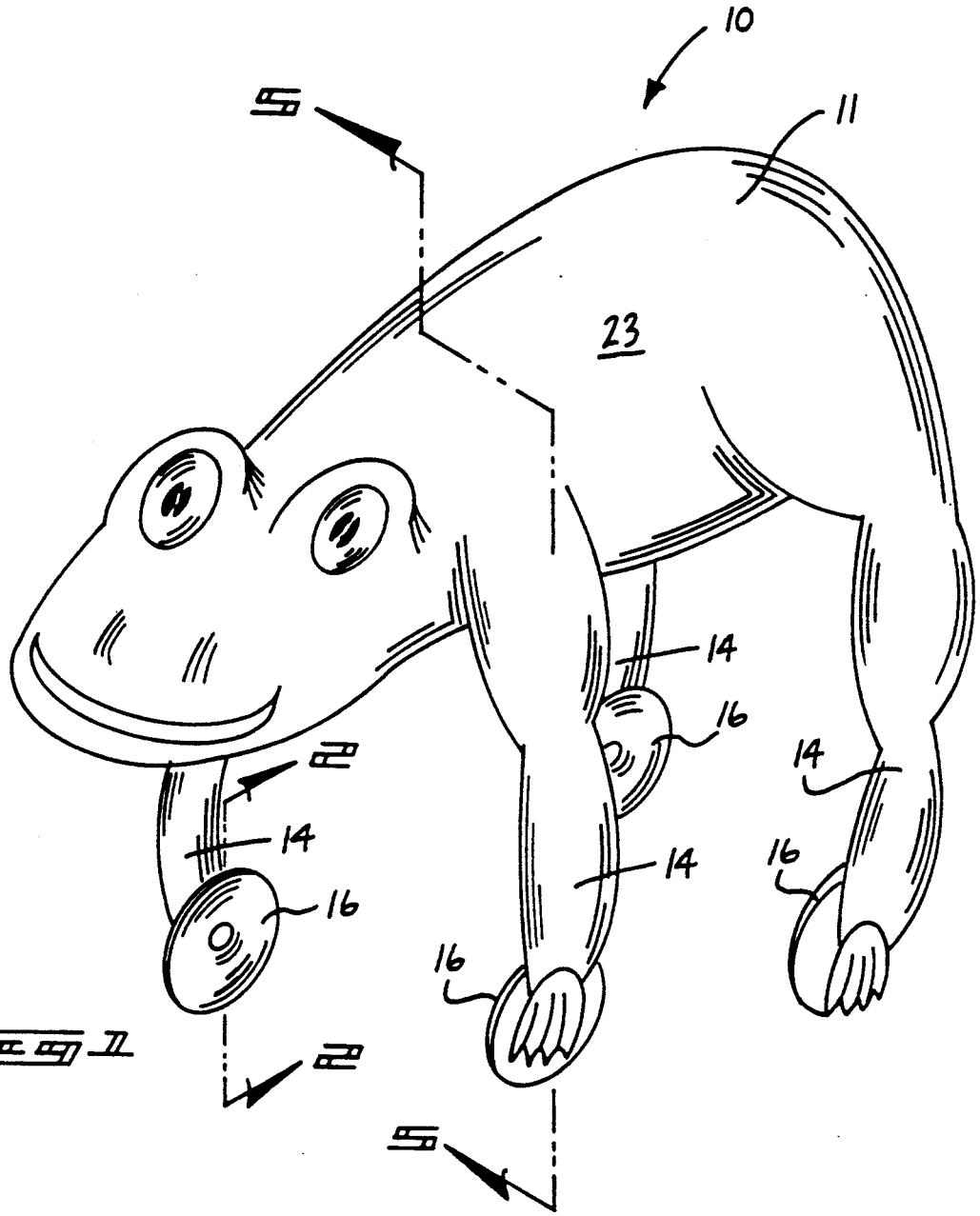
FIG. 1 is an isometric illustration of the body structure of the invention.
Figure 2:
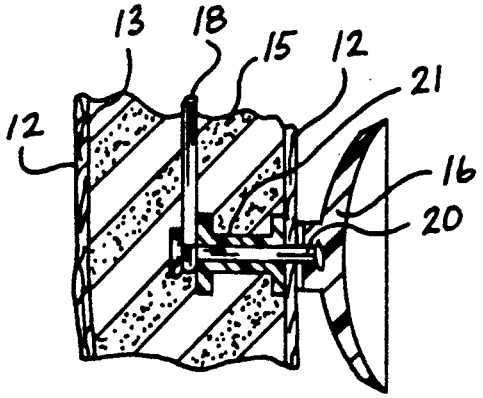
FIG. 2 is an orthographic view, taken along the lines 2—2 of FIG. 1 in the direction indicated by the arrows.

With reference now to the drawings, and in particular to FIGS. 1 to 11 thereof, a new and improved toy door stop embodying the principles and concepts of the present invention and generally designated by the reference numeral 10 will be described.

Figure 3:
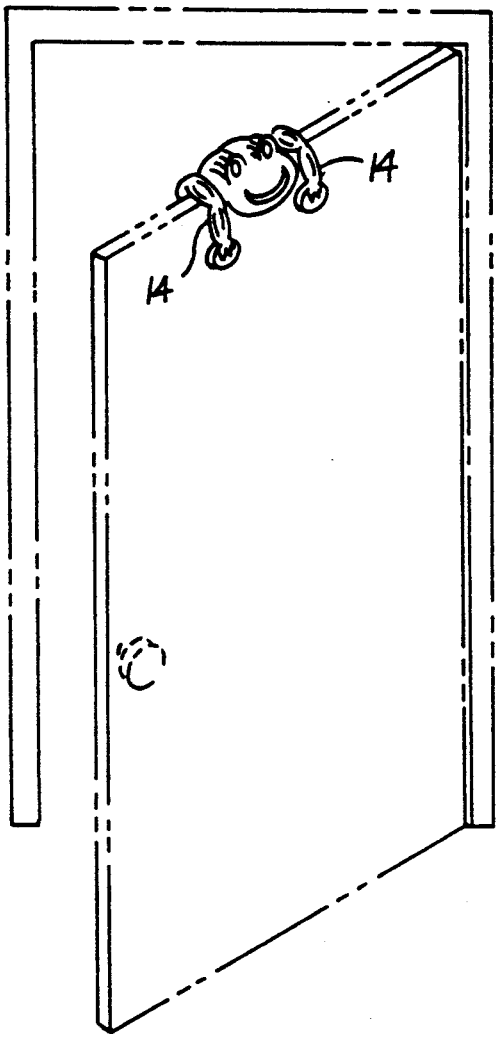
FIGS. 3 and 4 are isometric illustrations indicating the mounting of the invention relative to a door member.
Figure 4:
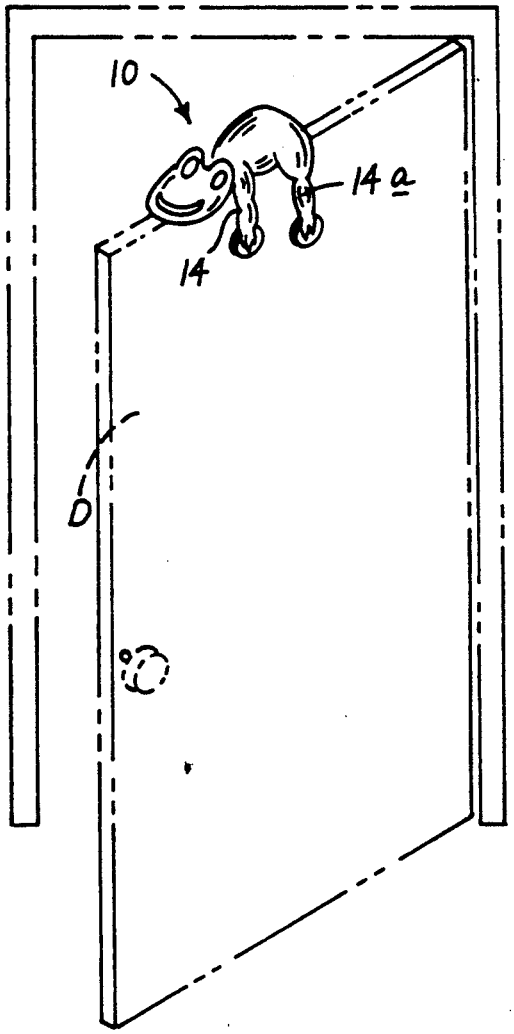
Figure 5:
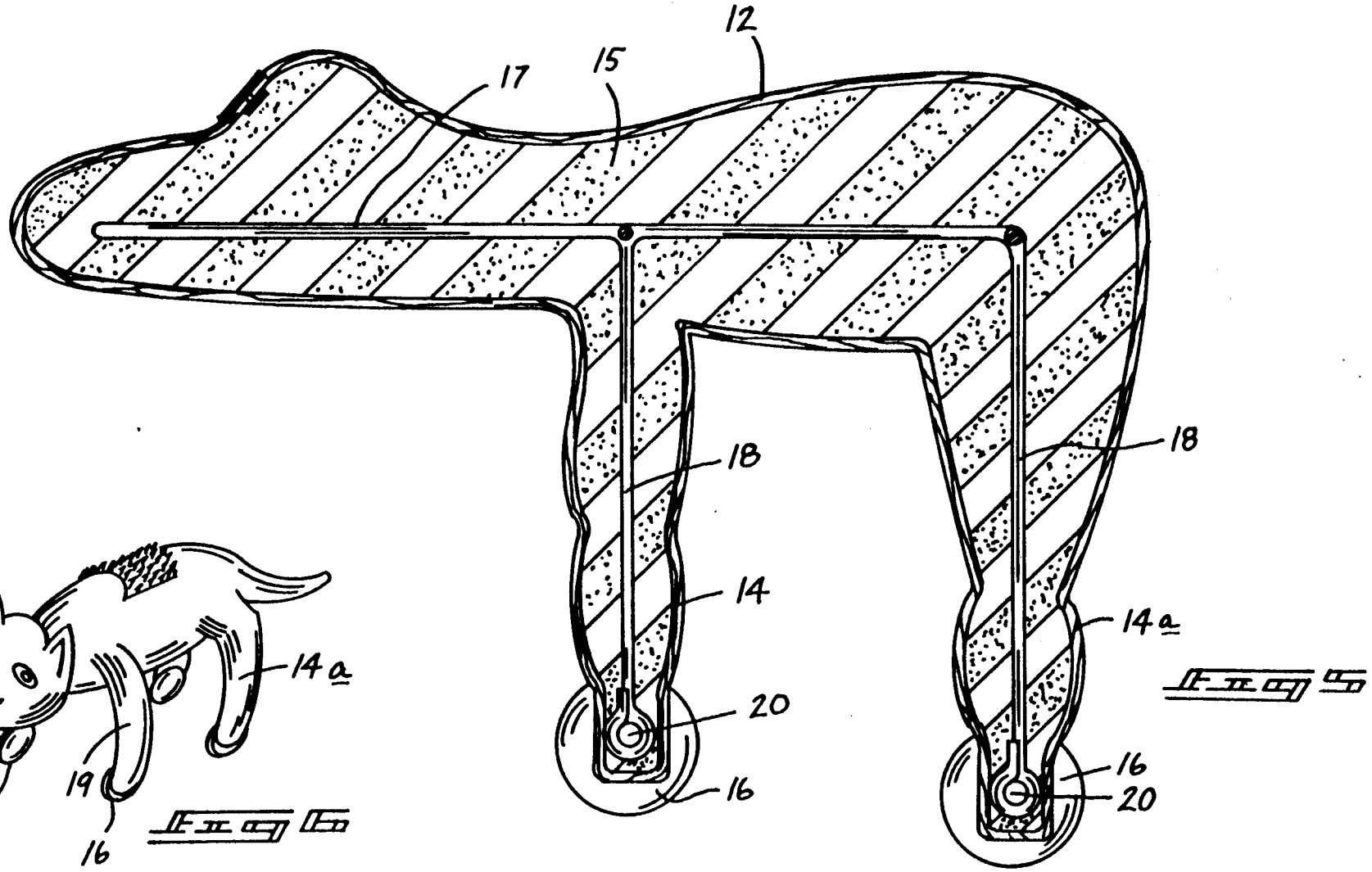
FIG. 5 is an orthographic view, taken along the lines 5—5 of FIG. 1 in the direction indicated by the arrows.
Figure 11:
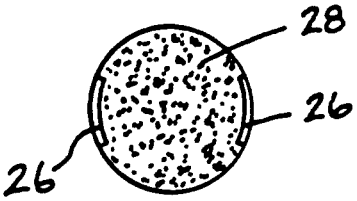
FIG. 11 is an orthographic view, taken along the lines 11—11 of FIG. 8 in the direction indicated by the arrows.

More specifically, the toy door stop 10 of the instant invention is arranged as an animal simulation FIG. 11, having a figure body 23 to include a figure body bottom surface, having a plurality of forward and a plurality of rear appendages 14 and 14*a* respectively directed downwardly from the figure body bottom surface. The figure body and the appendages are formed of an outer flexible web 12 enclosing a body cavity 13 that in turn is filled with a polymeric foam core 15 coextensively directed within the body cavity 13. Facing suction cup members 16 are mounted to respective forward and rear appendages 14 and 14*a* to define respective pairs of the suction cup members. A malleable primary body rod 17 is directed through the body 23, having an appendage rod 18 fixedly mounted to the body rod, with a separate appendage rod 18 directed into each of the appendages 14 and 14*a* medially thereof. A pivot shaft 20 is orthogonally and rotatably mounted to a free distal end of each appendage rod 18, with the pivot shaft 20 rotatably directed through a polymeric bushing 21 that extends from the free distal end of the appendage rod 18 towards the outer flexible web 12 of each of the appendages 14 and 14*a*. In this manner, alignment and rotation of the suction cups to accommodate securement to an associated door 12, in a manner as indicated in FIGS. 3 and 4, is available.

Figure 6:
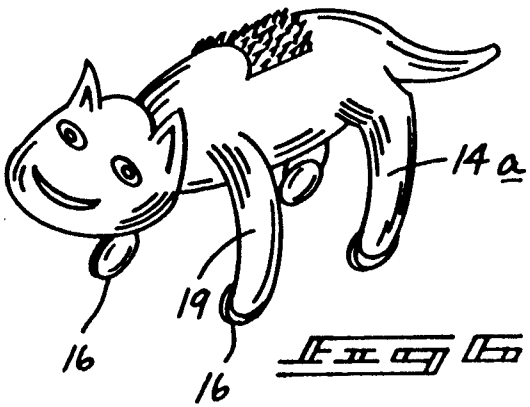
FIG. 6 is an isometric illustration of a modified configuration of the animal simulation figure.
Figure 7:
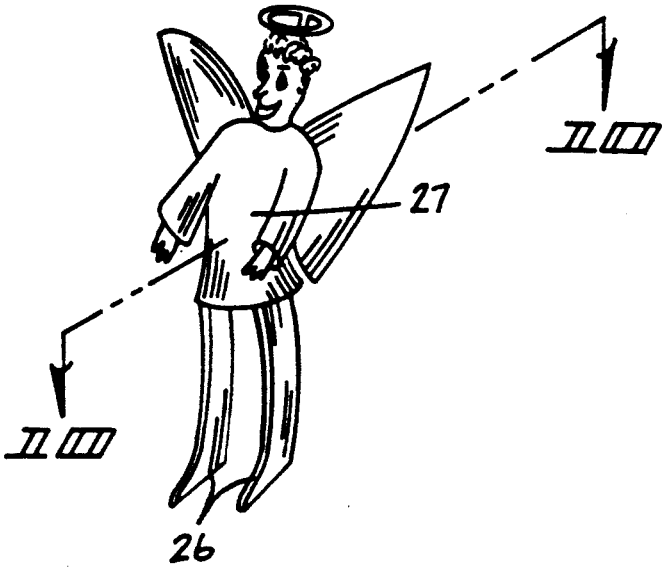
FIGS. 7 and 8 are isometric illustrations of attachment figures for use by the invention as set forth in FIG. 9.
Figure 8:
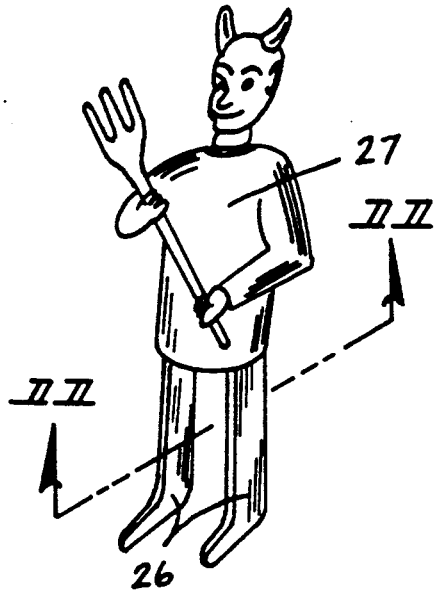
Figure 9:
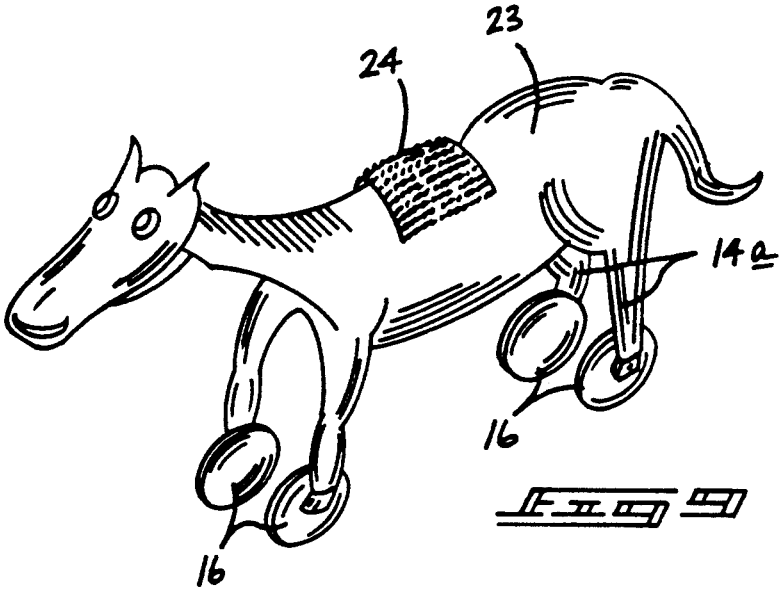
FIG. 9 is an isometric illustration of a further animal simulation figure for use by the invention.
Figure 10:
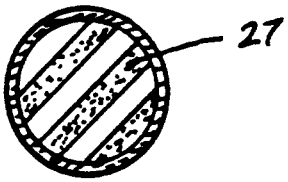
FIG. 10 is an orthographic view, taken along the lines 10—10 of FIG. 7 in the direction indicated by the arrows.

The FIGS. 6 and 9 indicate the use of the figure body 23 having a body top surface, including a hook and loop fastener web 24 mounted on the top surface intermediate the forward and rear appendages 14 and 14*a*. A mounting member 25 is provided to provide for additional height to the organization to insure projection beyond the door, with the mounting member 25 having flexible leg webs 26, including a mounting member body 27, with a mounting member hook and loop fastener web 28 mounted to the mounting member body 27 intermediate the leg webs 26 for securement to the hook and loop fastener web 24. In this manner, selective enlargement of the organization is available, wherein in instances of a door member "D" arranged in a spaced relationship relative to a surrounding door frame, additional height to the organization 10 is afforded.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy door stop, comprising, an animal simulation figure, having a figure body, the figure body including a first end spaced from a figure body second end, the figure body first end including a pair of forward appendages extending from a bottom surface of the figure body, with the forward appendages spaced from a pair of rear appendages extending from the figure body relative to the figure body bottom surface, and each of the appendages includes an appendage distal end, and each appendage distal end includes fastening means for securing the figure body to a door, and the fastening means includes a first pair of facing suction cup members mounted to the forward appendages, and a further pair of suction cup members mounted to the rear appendages on a facing relationship, and the figure body having a malleable body rod directed through the figure body, with the body rod including a plurality of appendage rods fixedly mounted to the body rod, with a single appendage rod of said appendage rods directed through each of the appendages, and each appendage rod includes an appendage rod free distal end, and each appendage rod free distal end includes a pivot shaft rotatably mounted to each appendage rod free distal end, and each pivot shaft is rotatably mounted within a polymeric bushing directed from the appendage rod to an exterior surface of the body.

2. A toy door stop as set forth in claim 1 wherein the figure body includes an outer flexible web having a polymeric foam core directed coextensively within the outer flexible web.

3. A toy door stop as set forth in claim 2 wherein the figure body includes a figure body top surface, the figure body top surface includes a hook and loop fastener web mounted to the figure body top surface, and a mounting member arranged for securement to the figure body top surface, with the mounting member including a mounting member body, with the mounting member body including a plurality of flexible leg webs extending from the mounting member body, and the mounting member body including a mounting member hook and loop fastener web mounted to the mounting member body between the flexible leg webs, wherein the mounting member hook and loop fastener webs are arranged for securement to the figure body hook and loop fastener web for securement of the mounting member to the figure body.

* * * * *